US005123139A

United States Patent [19]

Leppert et al.

[11] Patent Number: 5,123,139

[45] Date of Patent: Jun. 23, 1992

[54] BUFFING PAD ASSEMBLY

[75] Inventors: Dana Leppert, Millbury, Ohio; Lawrence E. Kerin, Santa Ana, Calif.; Steve Okun, Allentown, Pa.; Richard L. Sanders, Princeton; Roderick J. Finan, Medford, both of N.J.

[73] Assignee: Meguiar's, Inc., Irvine, Calif.

[21] Appl. No.: 642,079

[22] Filed: Jan. 16, 1991

[51] Int. Cl.[5] ..... B24D 13/14; B24B 29/00

[52] U.S. Cl. ..... 15/230.17; 15/97.1; 15/230; 51/170 T; 51/358

[58] Field of Search ..... 15/97.1, 98, 230, 230.17, 15/230.12; 51/170 T, 177, 358, 380

[56] References Cited

U.S. PATENT DOCUMENTS

| | | | |
|---|---|---|---|
| 3,302,232 | 2/1967 | Wasiloff et al. | 15/230.17 |
| 3,346,904 | 10/1967 | Armstrong | 15/230.17 |
| 4,114,225 | 9/1978 | Malish et al. | 15/230.17 |
| 4,692,958 | 9/1987 | McMakin | 15/230.17 |
| 4,907,313 | 3/1990 | Roeker et al. | 15/230.17 |
| 5,003,659 | 4/1991 | Paepke | 15/230.17 |
| 5,007,128 | 4/1991 | Englund et al. | 15/230 |

*Primary Examiner*—Edward L. Roberts
*Attorney, Agent, or Firm*—Lyon & Lyon

[57] ABSTRACT

A buffing pad assembly for use with a motorized drive tool comprising a cylindrical foam pad and a circular backing plate. The foam pad defines a front side and a back side and has a first circular layer of hook and loop type fastening material secured to the back side of the pad in axial alignment therewith. The layer of fastening material has a diameter less than the diameter of the pad and defines a centrally disposed aperture therein. The circular backing plate has a second circular layer of fastening material secured to the front side thereof in axial alignment therewith and having a centrally disposed aperture therein. The second circular layer of fastening material is adapted to abut and engage the first layer upon the pad being pressed against the plate, removably securing the pad to the plate. A centering member extends between the pad and the plate through the apertures in the first and second layers of fastening material for axially aligning the plate with the pad upon the pad being pressed against the plate. A threaded recess is provided in the back side of the plate for securing the plate to a motorized drive tool.

10 Claims, 1 Drawing Sheet

BUFFING PAD ASSEMBLY

BACKGROUND OF THE INVENTION

The present invention relates to a new buffing pad assembly particularly adapted for use in cleaning, polishing and waxing polishing the paint finish on a motor vehicle. Over 25 years ago, Meguiar's, Inc. under its predecessor name, Mirror Brite Polish Company, Inc., developed the use of foam pads for cleaning, waxing and polishing automobile finishes. While foam pads remain the industry standard today, their use is quite time consuming. Depending on the quality of the paint on the vehicle and the finish desired, the waxing and polishing process can employ several steps and the use of a number of different products. These steps can include the application of a cleaner to remove paint oxidation and foreign matter, the application of the wax, buffing or polishing and, in some applications, a final finishing polish with a fine finishing pad. Again, depending on the particular job, different types of products are often used for a particular step in the process. As in each application of a particular product, the foam pad will absorb some of that product, it is necessary to dedicate a single pad to a single product to prevent contamination of the pad which would have a deleterious effect on the process.

Foam pad systems heretofore in use employ a foam pad which is glued onto a rigid backing plate. The plate is then secured to a motorized drive tool such as a rotary or orbital buffer or polisher. Accordingly, for each step in the process it is necessary to detach the pad and backing plate from the drive tool and secure in place a new pad and plate. In the professional market place, this pad replacement is time consuming and costly. When a pad becomes overly worn and needs replacement, the backing plate to which the pad is secured must also be discarded. It would be highly desirable to provide an assembly Which reduces the time necessary to replace the foam pads and which would allow for the reuse of the backing plates which are still in excellent condition when the useful life of the foam pad has been exhausted.

Attempts have been made to utilize Velcro hook and loop fasteners to removably secure buffing pads to a backing plate in an effort to make the pad readily detachable from the plate and thereby significantly reduce the time it takes to replace the pad. However, such attempts have not proved successful due to the difficulty of properly centering the pad on the backing plate. An off-centered pad creates a balancing problem causing the pad to wobble. The resulting vibration fatigues the operator, results in an inferior buffing job and can damage the finish. It would be desirable to employ a hook and loop fastening system in a foam pad assembly to solve the aforesaid time replacement problem if the alignment problem could also be resolved. The foam pad assembly of the present invention achieves this result.

SUMMARY OF THE INVENTION

Briefly the buffing pad assembly of the present invention includes a cylindrical foam pad having a radiused forward perimeter edge for minimizing the creation of swirl marks in the finish and having a circular layer of Velcro loop fastening material secured to the backside thereof. The layer of fastening material is sized such that the perimeter edge thereof is inwardly spaced from the perimeter of the sidewall of the pad to prevent contact between the fastening material and the paint finish. The fastening material defines a centrally disposed, axially aligned centering aperture therein. The backing plate of the assembly is circular and substantially equal in diameter to the diameter of the fastening material carried by the foam pad. A circular layer of Velcro hook fastening material is secured to and covers the front side of the plate for mating engagement with the loop fastening material on the pad, releasably securing the pad to the backing plate. The backing plate defines a centrally disposed centering member projecting axially from the front side thereof and sized so as to be snugly received by the aperture in the loop fastening material for centering the pad on the backing plate. The rear side of the plate defines a threaded bore aligned with the centering member for securing the assembly to the drive shaft of a motorized drive tool.

In an alternate embodiment of the invention, a rearwardly projecting centering member is disposed over the aperture in the loop fastening material on the backside of the pad. The fastening member defines an annular radially projecting base portion which is secured between the pad and the portion of the loop securement material on the pad which is disposed about the aperture therein, and a rearwardly projecting portion having a central recess therein which cooperates and mates with an annular recessed area disposed about a centrally disposed axial projection defined in the forward side of the backing plate for centering the pad on the backing plate and avoiding any intrusion of the centering means into the foam pad.

With either embodiment of the present invention, the centering means on the backside of the buffing pad need only be aligned with the cooperating centering means on the front side of the backing plate and the pad pressed against the plate whereupon the hook and loop fastening materials will interlock, securing the pad to the backing plate in axial alignment therewith. To replace the foam pad for the application of a different product, it is only necessary to strip the pad from the backing plate and secure a new pad in the manner described.

It is the principal object of the present invention to provide an improved buffing pad assembly for use in cleaning, waxing and polishing the paint finish on a motor vehicle which minimizes the time necessary to replace the pad for the application of a different product to the finish.

It is another object of the present invention to provide an improved foam pad assembly for use in cleaning, waxing and polishing the paint finish on a motor vehicle which utilizes a hook and loop fastening securement between the pad and backing plate to facilitate pad replacement and which readily centers the pad on the backing plate to avoid pad wobble and vibration.

It is yet another object of the present invention to provide an improved foam pad assembly for use in cleaning, waxing and polishing the paint finish on a motor vehicle which minimizes the time necessary for pad replacement without deleteriously affecting the polishing performance of the pad and which is of simple construction and economical to manufacture.

These and other objects and advantages of the present invention will become apparent from the following detail description taken in conjunction with the accompanying drawings.

DESCRIPTION OF THE PREFERRED EMBODIMENT

Figure 1:
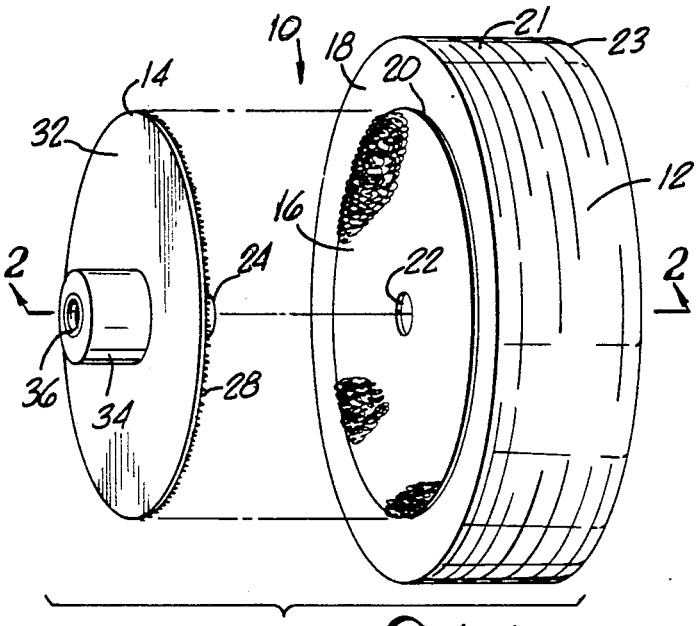
FIG. 1 is a perspective view of the foam pad assembly of the present invention showing the buffing pad separated from and aligned with the backing plate.
Figure 2:
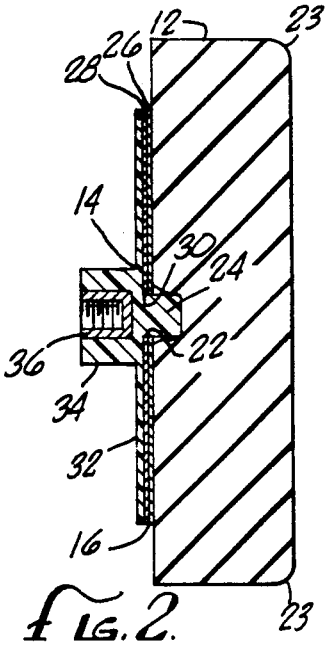
FIG. 2 is a sectional side view of the foam pad assembly of the present invention showing the foam pad secured to the backing plate.

Referring now in detail to the drawings, a first embodiment of the present invention is illustrated in FIGS. 1 and 2. As seen therein, the buffing pad assembly 10 comprises a cylindrical foam pad 12, preferably formed of thermally or chemically reticulated foam esters and ethers, and a backing plate 14 preferably formed of high impact styrene plastic. A circular layer of Velcro loop fastening material 16 is affixed to the backside 18 of pad 12 by a suitable adhesive such as 3M Brand No. 45-NF clear foam adhesive. The Velcro material used for layer 16 is marketed by Velcro U.S.A. under the designation RG-L 361. The layer of fastening material 16 defines a diameter which is less than the diameter of pad 12 so as to recess the perimeter edge 20 of the layer of loop fastening material 16 radially inwardly from the cylindrical sidewall 21 of the foam pad 12 to avoid any risk of damage to the paint surface during polishing by the fastening material. Layer 16 defines a centering aperture 22 therein which is centrally disposed therein and axially aligned with the common central axes of foam pad 12 and layer 16.

The forward perimeter edge 23 of pad 12 is preferably radiused to prevent the formation of swirl marks in the paint finish when lifting the pad from the finish. With a pad 12 having a diameter of 8 inches and a thickness of 1.875–2.0 inches (including the thickness of 0.06 inches of the Velcro material 16) a radius of 0.43 inches, has proved highly successful in preventing the creation of swirls in the finish.

The circular backing plate 14 defines a cylindrical centering member 24 which is preferably integrally molded therewith and projects axially from the forward surface 26 of plate 14. Centering member 24 is centrally disposed on plate 14 such that it is an axial alignment with the central axis of plate 14 and is sized so as to be relatively snugly received within the centering aperture 22 in the layer 16 of Velcro loop material on pad 12. A circular layer of Velcro hook material 28 having a central aperture 30, therein is secured to the forward surface of 26 of plate 14 by a suitable adhesive such that it substantially covers surface 26 with the centering member 24 projecting through aperture 30 therein. The Velcro material used for layer 28 is marketed by Velcro U.S.A. under the designation No. 65 and employs woven nylon hooks. The back side 32 of plate 14 defines a centrally disposed cylindrical hub 34 thereon which is also preferably integrally formed with the plate and is in axial alignment with centering member 24. Hub 34 has a threaded metal insert 36 secured therein for threadably engaging the backing plate 14 to the shaft of a motorized drive tool (not shown). Alternatively, the bore of hub 32 could itself be threaded for direct engagement with the drive tool. However, as the backing plate 14, centering member 24 and hub 32 are preferably molded of a plastic material, the use of a metal insert 34 facilitates removal of the plate from the drive tool due to the resulting metal to metal contact as opposed to a plastic to metal contact which may tend to bind and cause wear on the plastic threads.

To secure the buffing pad 12 onto backing plate 14, it is merely necessary to align the centering member 24 on the backing plate 14 with the aperture 22 in the layer of loop fastening material 16 on pad 12 and press the pad against the backing plate such that the centering member 24 passes through aperture 22, slightly compressing and displacing the foam thereunder. The layer of hook fastening material on the plate engages the layer of the loop fastening material 16 on pad 12, thereby centering and securing the foam pad 12 to the backing plate 14. To replace the foam pad 12 with another pad for use with a different product, it is only necessary to strip the pad from the backing plate and replace a new pad as described.

In the embodiment of the invention illustrated in FIGS. 1 and 2, the foam pad 12 defines a diameter of about 8 inches and a thickness of 1.875–2.0 inches. The backing pad 14 and the layers 16 and 18 of velcro material are 6–6.5 inches in diameter so that the foam pad 12 projects radially from the backing plate. By so spacing the perimeter of the backing plate from the side of the pad, the pad can be used at an angle with respect to its central axis without overly compressing the side of the pad against the backing plate which could otherwise tend to create swirl marks in the finish or, in some cases, even burn the finish. The above dimensions however, could be changed without departing from the scope of the present invention.

Figure 3:
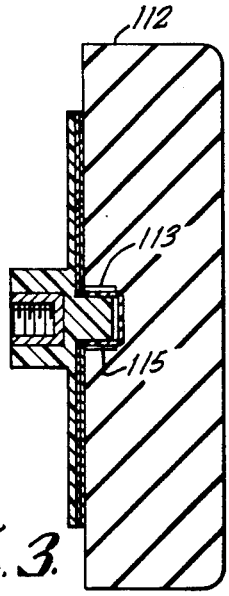
FIG. 3 is a sectional side view of a modified foam pad of the present invention.

FIG. 3 illustrate a modification of the foam pad of the present invention wherein the pad 112, which is otherwise identical to pad 12, has a centrally disposed cylindrical recess 113 in the back side thereof and a tubular hollow guide member 115 secured within the recess 113 by an adhesive. The guide member defines an internal diameter slightly larger than to the diameter of the centering member 24 on the backing plate so that the guide member 115 can receive the centering member 24 carried by the pad 112 upon the pad being aligned with and pressed against a backing plate 16.

Figure 4:
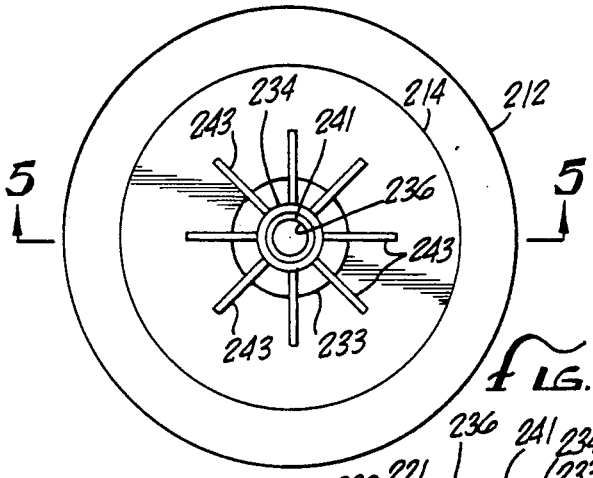
FIG. 4 is a top view of an alternate embodiment of the present invention.
Figure 5:
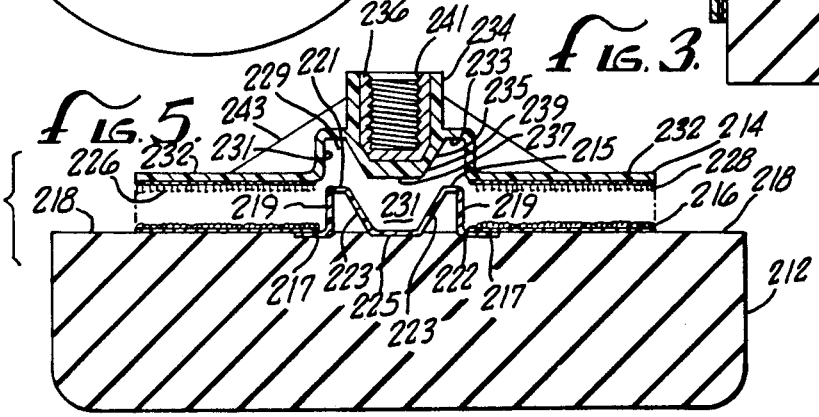
FIG. 5 is a sectional view of an alternate embodiment of the present invention taken along line 5—5 in FIG. 4.

FIGS. 4 and 5 illustrate an alternate embodiment of the invention which is designed to prevent the intrusion of the centering means into the foam pad to prevent any possibility of the centering means contacting the paint finish during use such as could occur if the pad were to become overly worn and excess pressure were applied by the user. This alternate embodiment of the invention comprises: a foam pad 212; a circular layer of Velcro loop fastening material 216 affixed to the backside 218 of pad 212; a centering member 215 carried by and projecting axially from the backside 218 of pad 212; a backing plate 214; and a layer of Velcro hook fastening material 228 affixed to plate 214.

Pad 212 is identical in configuration to pad 12 of the first embodiment. Centering member 215 is preferably molded of high impact styrene plastic and defines a flat annular base portion 217 projecting radially therefrom, an outer rearwardly projecting cylindrical wall surface 219, an annular rear horizontal wall surface 221 and a frustro-conical inner wall surface 223 terminating in a bottom wall surface 225 which lies in the same plane as base portion 217. Surfaces 223 and 225 define a centrally disposed and frusto-conical centering slot 227. The flat base portion 217 and bottom wall surface 225 of the centering member abut the backside 218 of pad 212 and are secured thereto by a suitable adhesive. The layer of Velcro loop material 216 carried by pad 212 defines a centrally disposed aperture 222 therein such that the centering member 215 projects therethrough with the portion of fastening material 216 disposed about the perimeter of aperture 222 extending over the annular base portion 217 of centering member 215 and being secured thereto by a suitable adhesive as seen in FIG. 5.

Backing plate 214 defines a flat annular front surface 226 disposed about a centrally disposed annular recess 229 adapted to receive the projecting wall surfaces 219, 221 and 223 of the centering member 215 as seen in FIG. 5. Recess 229 is defined by a cylindrical outer surface 231, flat rear surface 233, tapered inner surface 235 and forward surface 237 which are configured to abut surfaces 219, 221, 223 and 225 of the centering member 215 with surfaces 235 and 237 defining a central tapered centering projection 239 adapted to be received in the centering slot 227 in the centering member 215.

The layer of Velcro hook fastening material 224 is secured to and disposed about the forward surface 226 of plate 214 and is of an annular configuration so as to be disposed about the central recess 229 in backing plate 214. The backing plate also defines a centrally disposed cylindrical hub 234 on the back side 232 thereof rearwardly of surface 237. Hub 234 has a centrally disposed cylindrical recess 241 therein. A threaded metal insert 236 is secured within recess 241 for threadably engaging the backing plate to the drive shaft of a motorized drive tool (not shown). A plurality of tapered support ribs 243 are preferably integrally formed with the backing plate 214 and project between hub 234 and the back side of the plate 214 to provide additional structural support for hub 232. Similar supporting ribs could also be provided on the embodiment of the invention illustrated in FIGS. 1 and 2 if the hub 34 were reduced in size so as to need additional structural support.

In use, the foam pad 212 need only be pressed against the forward surface 226 of the backing plate 214 to center and secure the foam pad onto the backing plate. Through such a configuration, any projection of the centering means on the backing plate into the foam pad is avoided.

Various other changes and modifications may be made in carrying out the present invention without departing from the spirit and scope thereof. Insofar as these changes and modifications are within the purview of the appended claims, they are to be considered as part of the present invention.

We claim:

1. A buffing pad assembly for use with a motorized drive tool, said assembly comprising:

a cylindrical foam pad defining a front side and a back side;

a first circular layer of fastening material secured to the back side of said pad in axial alignment therewith such that the central axis through said layer is coincident with the central axis of said pad, said first layer of fastening material having a diameter less than the diameter of said pad and defining a centrally disposed aperture therein;

a circular backing plate defining a front side, a back side and attachment means on said back side for securing said plate to a motorized drive tool;

a second circular layer of fastening material secured to the front side of said backing plate in an axial alignment therewith such that the central axis through said second layer is coincident with the central axis of said plate, said second layer of fastening material having a centrally disposed aperture therein and being adapted to abut and engage said first layer upon said pad being pressed against said plate, removably securing said pad to said plate; and centering means extending between said pad and said plate for axially aligning said plate with said pad upon said pad being pressed against said plate, said means extending through said apertures in said first and second layers of fastening material.

2. The buffing pad assembly of claim 1 wherein said first and second layers of fastening material comprise hook and loop type fastening means.

3. The buffing pad assemblies of claims 1 or 2 wherein said centering means comprises a member centrally disposed on and projecting axially from said front side of said backing plate through said aperture in said second layer of fastening material thereon and adapted to be inserted through said aperture in said first layer of fastening material for aligning said backing plate with said pad, said cylindrical member defining a cross-section substantially equal in size and configuration to said aperture in said first layer of fastening material.

4. The buffing pad assemblies of claims 1 or 2 wherein said centering means comprises a cylindrical member carried by and projecting axially from the back side of said foam pad through said aperture in said first layer, of fastening material, said member being axially aligned with the central axis of said pad, and a centrally disposed recessed area in the front side of said backing plate, said area being adapted to receive said cylindrical member therein for aligning said backing plate with said pad.

5. The buffing pad assemblies of claim 4 wherein said cylindrical member defines a flat annular base portion projecting radially therefrom and a centrally disposed bottom wall portion extending parallel to said base portion, said base portion and said bottom wall portion abutting and being secured to the back side of said pad and at least a portion of said base portion being disposed between said pad and said first layer of fastening material and being secured to said first layer of fastening material.

6. The buffing pad assemblies of claim 5 wherein said cylindrical member defines a frusto conical plate receiving area therein, said bottom wall portion being inwardly spaced from said annular base portion and defining the bottom wall of said receiving area and wherein said front side of said backing plate defines a frusto conical extension centrally disposed within said recessed area in said backing plate such that upon pressing said pad against said backing plate, said cylindrical member is received within said recessed area in said backing plate and said frusto-conical extension is received within said plate receiving area in said cylindrical member.

7. A buffing pad assembly for use with a motorized drive tool comprising:

a cylindrical foam pad defining a front side and a back side;

a first circular layer of hook and loop type fastening material secured to the back side of said pad in axial alignment therewith such that the central axis through said layer is coincident with the central axis of said pad, said first layer of fastening material having a diameter less than the diameter of said pad and defining a centrally disposed aperture therein;

a substantially rigid circular backing plate having a diameter less than the diameter of said pad and defining a front side, a back side, attachment means on said back side for securing said plate to a motorized drive tool and a centering member centrally disposed on and projecting axially from said front side, said member being adapted to be inserted through said aperture in said first layer of fastening material for aligning said backing plate with said pad; and a second circular layer of hook and loop type fastening material secured to the front side of said plate about said centering member, said second layer of fastening material being adapted to abut and engage said first layer upon said pad being pressed against said backing plate for removably securing said pad to said plate.

8. The buffing pad assembly of claim 7 including a centrally disposed recess area in the back side of said pad in axial alignment with said aperture therein and a tubular member disposed in said recessed area and adapted to receive said centering member on said backing plate upon said pad being pressed against said backing plate.

9. A buffing pad assembly for use with a motorized drive tool, said assembly comprising:

a cylindrical foam pad defining a front side and a back side;

a first circular layer of fastening material secured to the rear side of said pad in axial alignment therewith such that the central access through said layer is coincident with central axis of said pad, said first layer of fastening material having a diameter less than a diameter of said pad and defining a centrally disposed aperture therein;

a centering member carried by and projecting axially from the back side of said pad through said aperture in said first layer of fastening material, said member being axially aligned with the central axis of said pad and defining an annular base portion projecting radially therefrom between said pad and said first layer of fastening material, an outer cylindrical wall portion and a plate receiving area disposed inwardly of said cylindrical wall portion;

a circular backing plate having a diameter less than the diameter of said pad and defining a front side, a back side, attachment means on said back side for securing said plate to a motorized drive tool, a centrally disposed recessed area in the front side thereof and an axial centering projection centrally disposed within said recessed area such that upon the back side of said pad being pressed against the forward side of said backing plate said cylindrical member carried by said pad is received within said recessed area in said backing plate and the centering projection on said backing plate is received within said plate receiving area in said cylindrical member thereby centering said pad on said plate; and a second circular layer of fastening material secured to the forward side of said plate and defining an aperture therein centrally aligned with the central axis of said plate and extending about said recessed area therein, said second layer of fastening material being adapted to abut engage said first layer upon said pad being pressed against said plate.

10. The buffing pad assembly of claim 9 wherein said first and second layers of fastening material comprise hook and loop type fasteners.

* * * * *